US005528781A

United States Patent [19]

Suzuki et al.

[11] Patent Number: 5,528,781

[45] Date of Patent: Jun. 25, 1996

[54] DOME TYPE FEATHER QUILT

[76] Inventors: Hiroko Suzuki; Emi Suzuki; Yoshio Suzuki, all of 11-32 Toneyama 6-chome, Toyonaka-shi, Osaka, Japan

[21] Appl. No.: 342,726

[22] Filed: Nov. 21, 1994

[51] Int. Cl.[6] ..... A47G 9/00

[52] U.S. Cl. ..... 5/502; 5/413 R

[58] Field of Search ..... 5/423, 413, 467, 5/461, 482, 486, 485, 482, 494, 502

[56] References Cited

U.S. PATENT DOCUMENTS

| | | | |
|---|---|---|---|
| 429,894 | 6/1890 | Doremus | 5/485 |
| 622,812 | 4/1895 | Lapierre | 5/413 |
| 4,354,281 | 10/1983 | Satoh | 5/413 |
| 4,748,303 | 6/1988 | Emi et al. | 5/502 |

FOREIGN PATENT DOCUMENTS

| | | | |
|---|---|---|---|
| 6105735 | 4/1994 | Japan | 5/486 |

*Primary Examiner*—Steven N. Meyers
*Assistant Examiner*—Fredrick Conley
*Attorney, Agent, or Firm*—Koda and Androlia

[57] ABSTRACT

In a cubic-quilt type feather quilt in which a plurality of compartments are defined by partitioning the interior of the quilt with partition cloths and feathers are filled inside, there is provided a feather quilt which functions to cover up the body, eliminating the possibility that outside air may flow in the bed due to clearances on the body side or when peripheral portions of the quilt are turned up, and thus which offers a comfortable sleep. Among the partition cloths to define the interior of the quilt, which are arranged in the central part of the quilt except at least its peripheral portions, the lateral partition cloths (3) are so formed that both right and left side portions are curved downward and the central part is floated up. Thus, the feather quilt is formed into such a dome shape that the quilt wholly covers up the body during sleep.

12 Claims, 6 Drawing Sheets

DOME TYPE FEATHER QUILT

BACKGROUND OF THE INVENTION

1. Field of the Invention

The present invention relates to feather quilts of the cubic quilt type and, more particularly, to a feather quilt which well fits to a sleeping body so as to offer a warm, comfortable sleep without causing clearances on the body side or the like.

2. Description of the Prior Art

Generally, conventional cubic-quilt type feather quilts have been fabricated by joining together the peripheral edges of front and rear cloths by means of sewing or the like, then by forming the interior of the central part of the quilt except at least its peripheral portions into lattice-shaped compartments with partition cloths having a fixed width (height) and crossing one another laterally and longitudinally, and by filling feathers into the interiors of the compartments.

The present inventors have invented an improved feather quilt in which a large number of partition cloths extending widthwise are arranged in the central part of the quilt except at least its peripheral portions and the partition cloths are gradually thinning in width (height) from central toward side portions (Japanese Patent No. 1697267 and European Patent No. 254087).

Any of the conventional cubic-quilt type feather quilts has been made in planar fashion. That is, they have been fabricated-in such a way that the partition cloths have a fixed width or, at least, that the lower edge of the partition cloths is horizontal. Accordingly, when applied to the body, the quilt itself will not easily fit to the body, causing clearances on the body side or the like. Also, both sides of the quilt itself may float up such that cold outside air flows in, or the body, when having turned over, may be exposed to outside air, disadvantageously. In particular, those quilts filled with plump, highly resilient feathers would noticeably show these tendencies.

SUMMARY OF THE INVENTION

Accordingly, in view of these disadvantages of the prior art, the present invention has an object of providing a cubic-quilt type feather quilt which functions in a cubic fashion so as to cover up a man's body with the quilt itself, and which will neither permit outside air to flow in the bed during sleep nor will be turned up at its peripheral portions when the body has turned over.

To achieve the aforementioned object, according to the present invention, there is provided a cubic-quilt type feather quilt in which compartments are defined in the interior of the quilt by partition cloths, characterized in that, among the partition cloths for partitioning the interior of the quilt in its central part except at least its peripheral portions, lateral partition cloths are curved downward at their right and left sides, with their central part floated up.

By the arrangement that the lateral partition cloths are curved downward at their right and left sides, the central part of the quilt is floated up in a dome shape upper than the peripheral portions of the quilt, as shown in FIGS. 2 or 9. As a result, this quilt, when used for sleeping, fully covers the body within the dome, eliminating the possibility that outside air may flow in the bed during sleep due to clearances on the body side or turn-up of peripheral portions of the quilt.

DETAILED DESCRIPTION OF THE PREFERRED EMBODIMENTS

Hereinbelow, embodiments of the dome type feather quilt according to the present invention are described with reference to the accompanying drawings.

Figure 1:
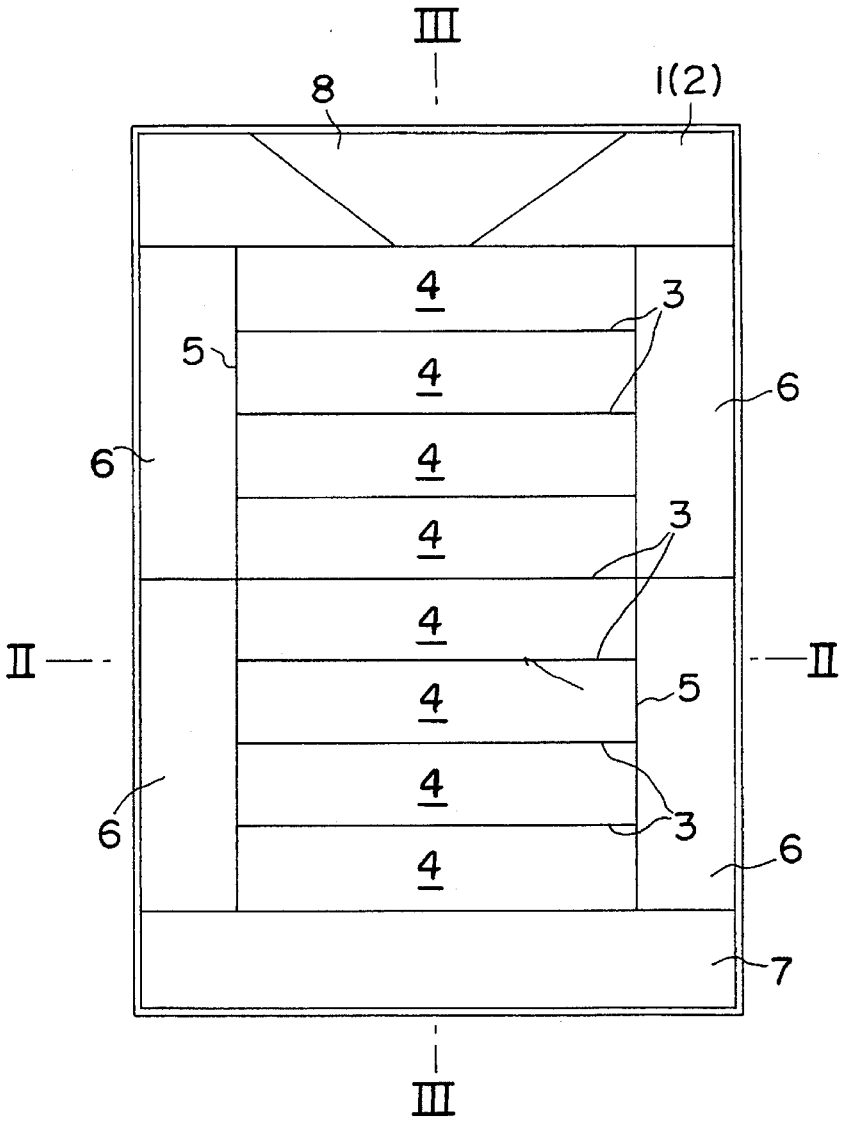
FIG. 1 is a plan view of the whole feather quilt according to the present invention, showing a first embodiment thereof.

FIG. 1 is a plan view showing an embodiment of the feather quilt. A front cloth 1 and a rear cloth 2 are joined together at their peripheral portions by means of sewing or the like. Inside the feather quilt, a plurality of partition cloths 3, 3 extending widthwise are provided with specified intervals in the central part of the quilt except at least its peripheral portions, to define a large number of compartments 4, 4. The compartments are filled with feathers.

Side compartments 6 are defined by longitudinal partition cloths 5 on both side portions of right and left of the quilt, while a foot-part compartment 7 and a chest-part compartment 8 are defined. These compartments 4 and 6, 7, 8 are each filled with feathers.

Figure 4:
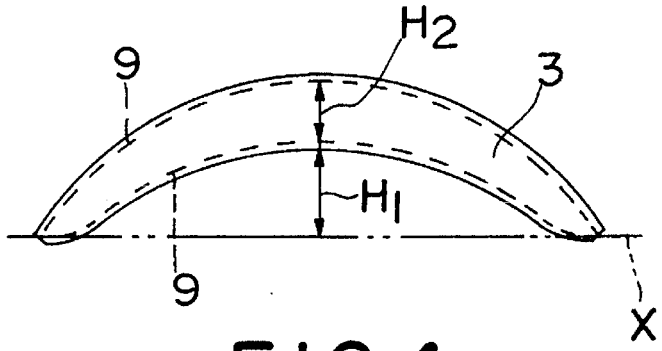
FIG. 4 is a front view of a partition cloth arranged in the central part of the feather quilt of the first embodiment.
Figure 5:
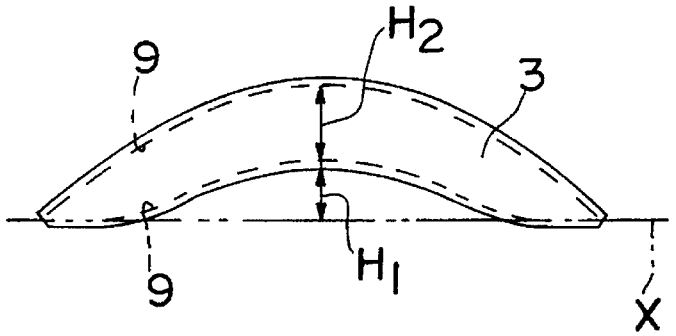
FIG. 5 is a front view of a partition cloth arranged near the foot of the feather quilt of the first embodiment.

The lateral partition cloths 3 in the central part of the quilt are formed into such a curved shape that the right and left sides descend downward by a height $H_1$ as shown in FIGS. 4 and 5, and that the width (height) $H_2$ of the partition cloths gradually decreases as it is farther away from the central part toward the sides. FIG. 4 shows an embodiment of the partition cloths 3 in the central part of the quilt, while FIG. 5 shows an embodiment of the partition cloths 3 arranged near the foot.

The partition cloth as shown in FIG. 5 is smaller in the curving dimension $H_1$ but larger in the width $H_2$ of the partition cloth itself than that as shown in FIG. 4. As a result, the quilt generally forms a dome-like shape matching the bodily shape, so that it can warm the foot that is likely to feel chilly. In the partition cloths 3 as shown in FIGS. 4 and 5, sewing lines 9 sewn to the front cloth 1 and the rear cloth 2 are indicated by broken line.

Figure 2:
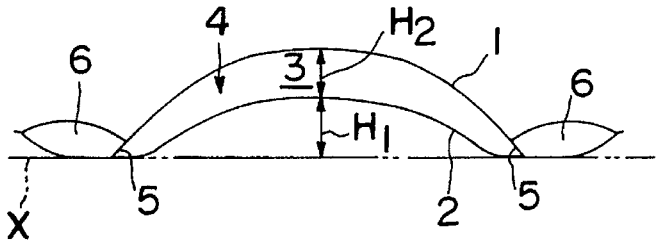
FIG. 2 is a sectional view taken along the line II—II of FIG. 1.
Figure 3:
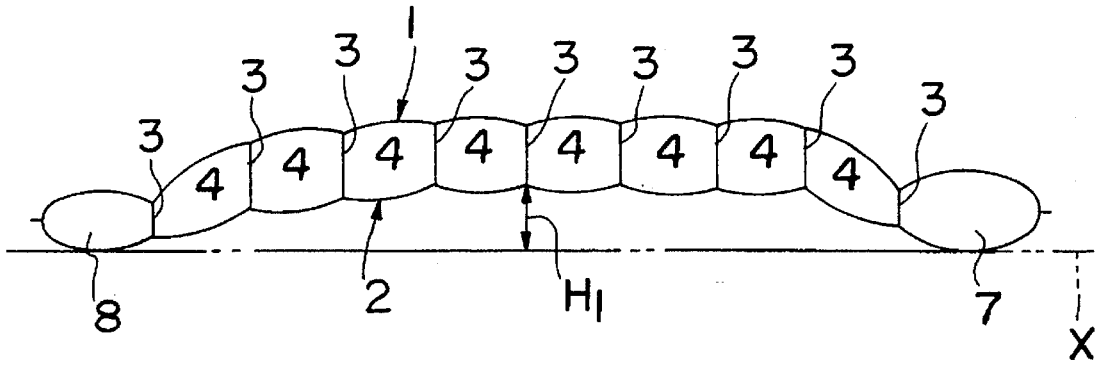
FIG. 3 is a sectional view taken along the line III—III of FIG. 1.

In the feather quilt in which compartments are defined in the interior of the quilt by sewing the partition cloths 3 as shown in FIGS. 4 and 5 and feathers are filled inside the compartments, peripheral portions are positioned at a reference level X, which is the lowest position, as shown in FIGS. 2 and 3, so that the central part of the quilt is floated up by $H_1$, resulting in a dome shape as a whole. Besides, in this embodiment, the side compartments 6 themselves are positioned at the reference level X, serving for effectively preventing outside air from flowing into the bed.

Next described is an efficient process for fabricating the feather quilt as shown in FIG. 1.

Figure 6:
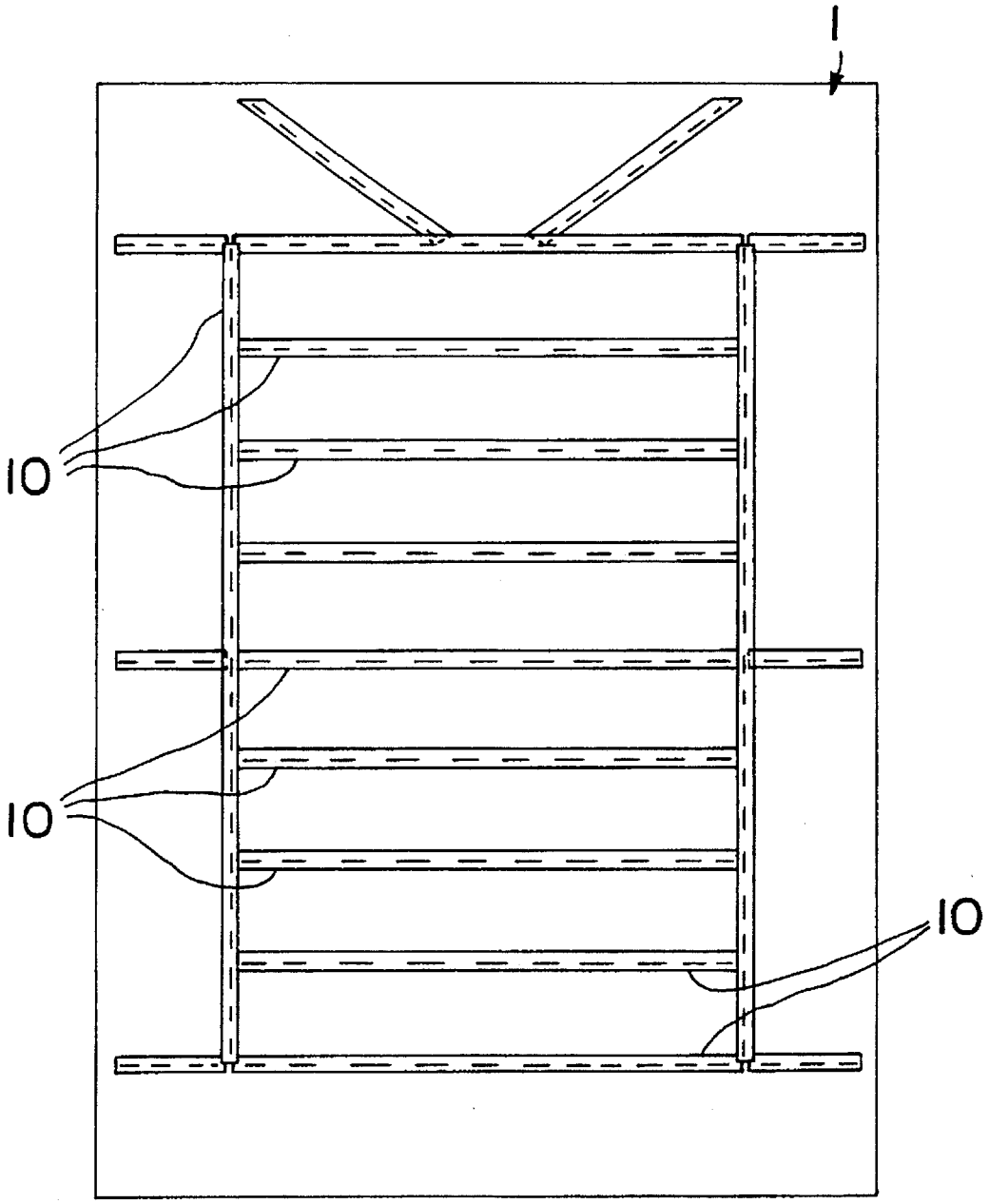
FIG. 6 is a plan view of the front cloth of the feather quilt of the first embodiment.
Figure 7:
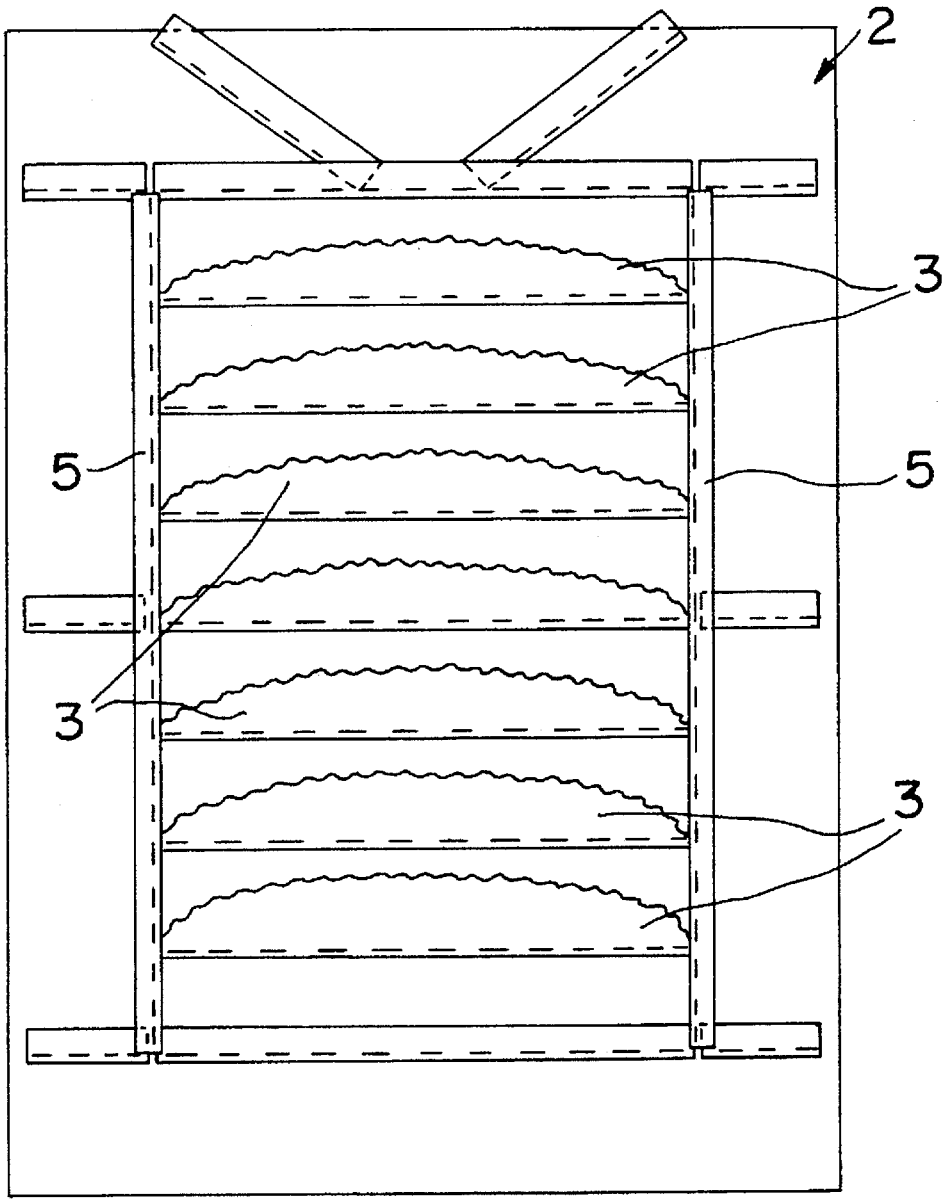
FIG. 7 is a plan view of the rear cloth of the feather quilt of the first embodiment.

FIG. 6 is a plan view showing the inner surface of the front cloth in the fabricating process, where docking tape 10 of small width are previously sewn to the inner surface of the front cloth 1 along the line on which the partition cloths are to be provided. In contrast to this, FIG. 7 is a plan view showing the inner surface of the rear cloth in the fabricating process, where lower edges of the partition cloths 3 and 5 are previously sewn at positions corresponding to the docking tape. The front cloth 1 to which docking tape has previously been sewn, and the rear cloth 2 to which the partition cloths 3, 5 have been sewn, in the aforementioned way, are overlaid on each other. Then, the docking tape and the partition cloths are sewn together from either top or bottom, and finally peripheral portions of the front and rear cloths are sewn together. Further, feathers are filled into the compartments 4, 4 defined by the partition cloths, thus completing the feather quilt.

It is also possible that the lower edges of the partition cloths are sewn directly to the rear cloth 2 while the upper edges are sewn directly to the front cloth 1, without using docking tape.

Figure 8:
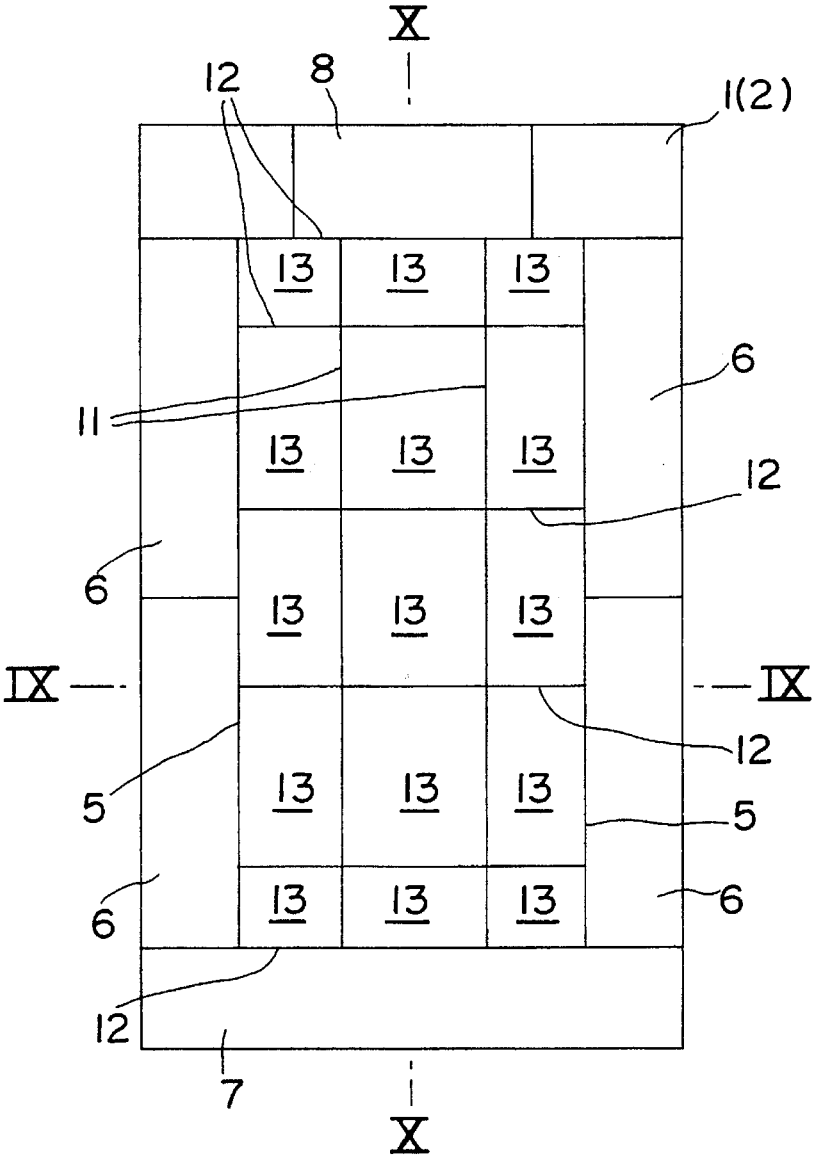
FIG. 8 is a plan view of the whole feather quilt according to the present invention, showing a second embodiment thereof.
Figure 9:
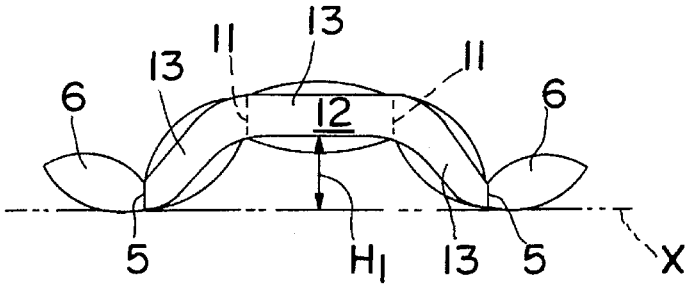
FIG. 9 is a sectional view taken along the line IX—IX of FIG. 8.

FIG. 8 is a plan view showing an embodiment of the present invention, where peripheral portions of the front cloth 1 and the rear cloth 2 are joined together by means of sewing or the like and, in the inside, lattice-shaped compartments 13, 13 are defined by longitudinal partition cloths 11 and lateral partition cloths 12.

As in the embodiment shown in FIG. 1, side compartments 6 are defined by longitudinal partition cloths 5 while a foot-part compartment 7 and a chest-part compartment 8 are defined.

In the present embodiment in which the longitudinal partition cloths 11 and the lateral partition cloths 12 cross each other, the partition cloths 11 and the partition cloths 12 cannot be provided both in continuous form. Therefore, the lattice-shaped compartments can be defined by forming the lateral partition cloths 12 into a continuous form as shown in FIG. 11, and sewing the longitudinal partition cloths 11 intermittently for each compartment.

Figure 11:
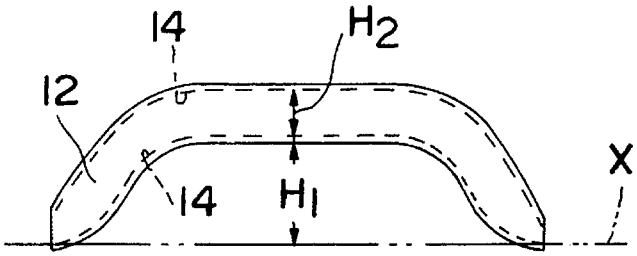
FIG. 11 is a plan view of a lateral partition cloth arranged in the central part of the feather quilt of the second embodiment.

FIG. 11 shows a lateral partition cloth 12 in the central part of the quilt. In this embodiment, the partition cloth 12 is so formed that the central part is horizontal while both side portions on the right and left are inclined surfaces with a down inclination of a height $H_1$. The width (height) $H_2$ of the partition cloth 12 itself is generally uniform as a whole. In the figure, sewing lines 14 between front and rear cloths are indicated by broken line.

Figure 12:
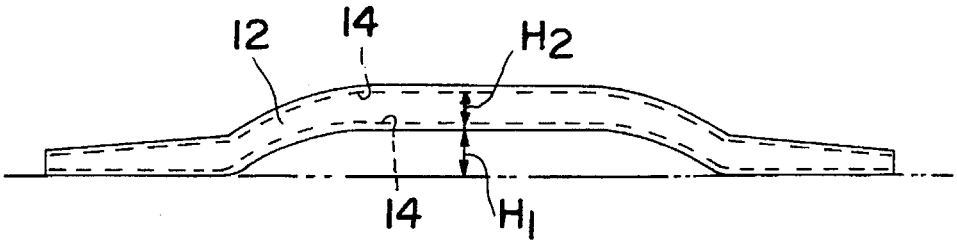
FIG. 12 is a plan view of a lateral partition cloth arranged near the foot of the feather quilt of the second embodiment.

FIG. 12 shows a lateral partition cloth 12 that is positioned the lowest, i.e., a partition cloth that forms a boundary to the foot-part compartment. In this partition cloth, the down dimension $H_1$ at the right and left side portions is made smaller than the dimension $H_1$ of FIG. 11, while the right and left ends are extended up to both ends of the quilt to serve also as the boundaries to the side compartments 6 and the foot-part compartment 7. Also in the lateral partition cloth 12 that is positioned uppermost, i.e., the partition cloth that forms a boundary to the chest-part compartment, the floating dimension $H_1$ is made smaller, as in the partition cloth shown in FIG. 12, so that a dome shape fully covering the body and matching the bodily shape can be formed as a whole.

Figure 10:
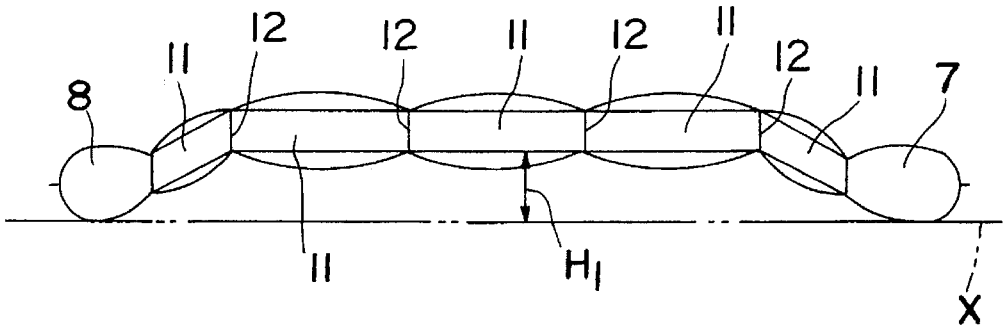
FIG. 10 is a sectional view taken along the line X—X of FIG. 8.

The longitudinal partition cloths 11 are provided as a rectangular partition cloth between adjoining lateral partition cloth 12 and partition cloth 12, as shown in FIG. 10, so that longitudinal partition cloths crossing the lateral partition cloths can be formed as a whole. Partition cloths that connect to the upper and lower ends, i.e., the chest-part compartments 8 and the foot-part compartment 7 are each formed into a parallelogram so that the partition cloths as a whole have such a form that the upper and lower ends are outwardly descending.

In the embodiments as shown in FIGS. 8 through 12, the lateral partition cloths 12 are formed in continuous fashion While the longitudinal partition cloths 11 are provided in intermittent fashion. However, it may also be arranged, conversely, that the partition cloths 11 are provided in continuous fashion while the lateral partition cloth 12 are composed of a plurality of portions in intermittent fashion. In this case, lateral partition cloths positioned at both ends are formed into parallelograms, while longitudinal partition cloths are formed into a shape of down inclination at their both ends.

According to the dome type feather quilt of the present invention as set forth in claims 1 to 4, the quilt itself is formed into a dome shape matching the bodily shape. Therefore, the quilt functions to fully cover the whole body, eliminating the possibility that outside air may flow in the bed through clearances on the body side during sleep, or that the body may be exposed to outside air due to turn-up of peripheral portions of the quilt. Thus, the dome type feather quilt has an advantage of ensuring a calm sleep.

Particularly for people of big bodies such as sumo wrestlers, it has been difficult to fully cover the whole body with conventional feather quilts. However, according to the present invention, it becomes possible for people of any build to obtain an optimum sleep by the provision of a dome shape of the quilt matching the build.

What is claimed is:

1. A dome type feather quilt comprising:

a front cloth and a rear cloth joined together at peripheral portions thereof, a plurality of lateral partition cloths provided between the front and rear cloths in the lateral direction of the feather quilt so that a plurality of compartments are formed between the front and rear cloths; and feathers filled in said compartments; and wherein upper edges of the partition cloths are arcuate and lower edges thereof are arcuate in a same direction with respect to the upper edges so that central portions of the lower edges are raised up with respect to reference lines which connect side-ends of the partition cloths with other side-ends thereof respectively.

2. A dome type feather quilt as claimed in claim 1, wherein said lateral partition cloths are provided in a center portion of the feather quilt.

3. A dome type feather quilt as claimed in claims 1 or 2, wherein distances raised up between the central portions of the lower edges and the reference lines gradually decrease from mid-portion towards foot and chest portions with respect to the longitudinal direction of the feather quilt.

4. A dome type feather quilt comprising:

a front cloth and a rear cloth joined together at peripheral portions thereof;

a plurality of lateral partition cloths provided between the front and rear cloths in the lateral direction of the feather quilt so that a plurality of compartments are formed between the front and rear cloths; and feathers filled in said compartments; and wherein upper edges of the partition cloths and lower edges thereof are provided such that central portions of the upper edges and the lower edges are parallel and are raised up with respect to reference lines which connect side-ends of the partition cloths with other side-ends thereof respectively, and both side portions of said upper and lower portions of said upper and lower edges of said partition clothes are inclined in opposite directions.

5. A dome type feather quilt as claimed in claim 4, wherein said lateral partition cloths are provided in a center portion of the feather quilt.

6. A dome type feather quilt as claimed in claim 4 or 5, wherein distances raised up between the central portions of the lower edges and the reference lines gradually decrease from mid-portion towards foot and chest portions with respect to the longitudinal direction of the feather quilt.

7. A dome type feather quilt comprising:

a front cloth and a rear cloth joined together at peripheral portions thereof, a plurality of lateral partition cloths and of longitudinal partition cloths provided between the front and rear cloths in a lateral direction and in a longitudinal direction of the feather quilt so that a plurality of lattice-shaped compartments are formed between the front and rear cloths; and feathers filled in said compartments, wherein upper edges of the lateral partition cloths are arcuate and lower edges thereof are arcuate in a same direction with respect to the upper edges so that central portions of the lower edges are raised up with respect to reference lines which connect side-ends of the lateral partition cloths with other side-ends thereof respectively.

8. A dome type feather quilt as claimed in claim 7, wherein said lateral partition cloths and longitudinal partition cloths are provided in a center portion of the feather quilt.

9. A dome type feather quilt as claimed in claim 7 or 8, wherein distances raised up between the central portions of the lower edges and the reference lines gradually decrease from mid-portion towards foot and chest portions with respect to the longitudinal direction of the feather quilt.

10. A dome type feather quilt comprising:

a front cloth and a rear cloth joined together at peripheral portions thereof, a plurality of lateral partition cloths and of longitudinal partition cloths provided between the front and rear cloths in a lateral direction and in a longitudinal direction of the feather quilt so that a plurality of lattice-shaped compartments are formed between the front and rear cloths; and feathers filled in said compartments, wherein upper edges of the lateral partition cloths and lower edges thereof are provided such that central portions of the upper edges and the lower edges are parallel and are raised up with respect to reference lines which connect side-ends of the lateral partition cloths with other side-ends thereof respectively, and both side portions of said upper and lower portions of said upper and lower edges of said partition clothes are inclined in opposite directions.

11. A dome type feather quilt as claimed in claim 10, wherein said lateral partition cloths and longitudinal partition cloths are provided in a center portion of the feather quilt.

12. A dome type feather quilt as claimed in claim 10 or 11, wherein distances raised up between the central portions of the lower edges and the reference lines gradually decrease from mid-portion towards foot and chest portions with respect to the longitudinal direction of the feather quilt.

* * * * *